United States Patent [19]

Gregory et al.

[11] 4,052,571

[45] Oct. 4, 1977

[54] HEARING AID WITH AMPLITUDE COMPRESSION ACHIEVED BY CLIPPING A MODULATED SIGNAL

[75] Inventors: Richard Langton Gregory; Ian Alexander Low, both of Bristol, England

[73] Assignee: National Research Development Corporation, London, England

[21] Appl. No.: 737,162

[22] Filed: Oct. 29, 1976

[30] Foreign Application Priority Data

Nov. 7, 1975 United Kingdom ..... 46190/75

[51] Int. Cl.[2] ..... H04R 25/00

[52] U.S. Cl. ..... 179/107 R; 179/107 FD; 333/14

[58] Field of Search ..... 179/107 R, 107 FD

*Primary Examiner*—George G. Stellar

*Attorney, Agent, or Firm*—Cushman, Darby & Cushman

[57] ABSTRACT

A hearing aid is arranged to restrict the dynamic range of the audio input signal to be compatible with the range which is characteristic of the hearing defect of the user. By means of phase-shift modulation for example, the input signal is converted to a single sideband at HF which is then peak-clipped to a predetermined value. The effective degree of clipping is determined by the AGC level of an input amplifier which is controlled by the user. The clipped signal is restored to the audio band for reproduction at a preset level.

10 Claims, 2 Drawing Figures

Fig. 1

HEARING AID WITH AMPLITUDE COMPRESSION ACHIEVED BY CLIPPING A MODULATED SIGNAL

Figure 1:
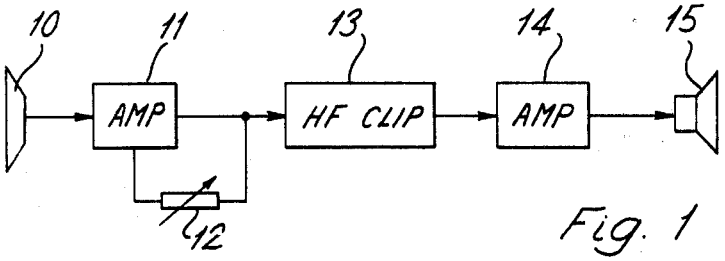

This invention relates to a hearing aid adapted particularly by not exclusively to the amelioration of nerve deafness.

Two general forms of deafness are recognised, these being described as conduction deafness and nerve deafness respectively. In conduction deafness the amplitude of a vibration at the ear drum is attenuated during transmission by the ossicles through the cavity of the middle ear to the cochlea. In nerve deafness the losses occur in the inner ear and are usually associated with damage to the organ of Corti where the auditory nerve is stimulated via the hair cells by pressure changes in the fluid of the cochlea.

Conduction deafness commonly shows a uniformly distributed wide-band loss of sensitivity which may often be adequately compensated by the type of linear amplifier provided in known forms of hearing aid. Such aids are however generally not suitable for nerve deafness and may worsen the condition if the amplification is excessive.

It is an object of the invention to provide a hearing aid in which the disadvantage is overcome.

According to the invention a hearing aid comprises means reponsive to sound waves to produce an electrical input signal in the audio frequency band, means for transposing the input signal to a high frequency band, limiting means for limiting the peak amplitude of the transposed signal to a predetermined value, means for restoring the amplitude-limited signal to the audio frequency band and means for audio reproduction of the restored signal.

In a preferred form of the hearing aid, the means responsive to sound waves includes input amplifier means arranged to maintain the mean value of the electrical input signal at a substantially uniform level.

It is a particular advantage in the use of the hearing aid to provide means for manual adjustment of the level of the input signal while maintaining constant the predetermined value of amplitude at which peak limiting is arranged in the transposed signal.

This feature enables the user to vary the degree of peak limiting (or clipping) and so to adjust the dynamic range of the signal to be compatible with the dynamic range of his ear.

Preferably the means for audio reproduction includes output amplifier means in which the gain may be pre-set so that the maximum level of the audio output lies within the characteristic dynamic range of the hearing defect for which the aid is intended (that is, above the neural noise level and below that level which is sufficient to cause overload of the defective ear.)

The user, having previously adjusted the dynamic range of the signal, is enabled by this feature to adjust the absolute level of the audio output so that overload will never occur. Alternatively the adjustment may be made in the initial prescription of the aid.

The high frequency band should lie above the speech frequency band and preferably within the range 20 – 100 KHz.

Preferably the transposed signal comprises a single sideband in the high frequency band. Such a signal may be derived from a phase-shift modulator.

Preferably low-pass filter means is provided for removing any component of the restored signal which is of higher frequency than the audio frequency band which it is desired to reproduce.

The invention has arisen in the context of personal research into the perception of sound and the characteristics of deafness, particularly of nerve deafness. It has been found that nerve deafness differs from conduction deafness in two principal features. Firstly, the response to the higher frequencies of the audio spectrum is reduced and typically the effect is enhanced in the region of 4 KHz. This effect is generally associated with tinnitus which is the sensation of an internally generated hiss or whistling noise predominantly in the spectral region where the main hearing loss is experienced. Secondly there occurs the effect known as recruitment in which the response to a sound of high intensity may be nearly normal but as the intensity is reduced the level of sensation, relative to a normal ear, becomes lower and lower. Study of this combination of effects has led to the conclusion that nerve deafness follows damage to the nerve endings at the organ of Corti, but not to the auditory nerve itself, which causes masking of the auditory signal by neural noise. The results is that the dynamic range of sound which provides useful communication is much less than for a normal ear. Consequently the attempt to raise the lower levels of the wanted signal above the neural noise with a linear amplifier, such as a conventional hearing aid, is likely to overload the ear (that is, to exceed the upper limit of linear response), and possibly cause further injury, at peak levels. This realisation led to the further consideration of the way in which information is conveyed in speech. In fact almost all the information-content of speech is carried by the zero-energy change-over points of the speech wave and almost none by the energy peaks. This means that for speech to be intelligible, although devoid of emphasis, only frequency-change data is required; amplitude data is unnecessary. It thus appeared possible to prevent overloading, while retaining the necessary information, by clipping the peaks of the speech wave. The low-energy components of the wave could then be amplified above neural noise level while the higher-energy components would be limited to a tolerable level. In this way the restricted dynamic range of the ear would be most efficiently used. At the time when this conclusion was reached it seemed that it could not be put into practice with useful effect because of the severe harmonic and intermodulation distortion introduced by peak clipping at audio frequency. The distortion arises from the generation of sum and difference products of component frequencies of the speech signal as a result of the non-linearity of the clipping process; these products lie too close to the wanted frequencies to be removed by filtering. The result, for a person having good hearing, is that speech sounds unnatural but, with concentrated listening, may be intelligible; for a deaf person there is no improvement in communication.

The design problem therefore remained unsolved until the conception of the present invention which depends on the recognition that the requirements of the ideal nerve-deafness hearing aid as set out in the preceding paragraph may be satisfied by adapting a peak-clipping technique employed in modern single-sideband radio-transmission practice. This technique has arisen to satisfy two needs; first, to reduce the peak power demand in a transmitter in relation to mean power and second to improve the signal:noise ratio in short-wave transmission over a long distance. Both considerations are so remote from the field of hearing-aid development as hitherto to be unknown in that field or to appear irrelevant to it.

In this technique the speech waveform is first transposed to a single sideband at a higher frequency and then amplitude-clipped. The unwanted combination frequencies produced by clipping are harmonics of the high-frequency sideband and so are widely spaced. They can therefore be removed in an H.F. band pass filter without loss of signal information. The original speech signal is then restored by demodulation of the clipped and filtered carrier with reduced dynamic range but with minimal distortion.

Figure 2:
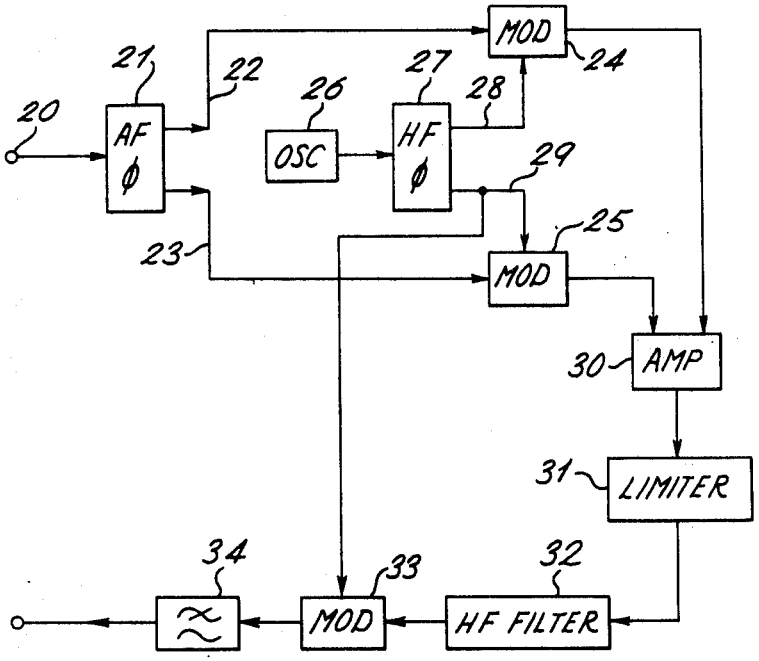

An embodiment of the invention will now be described with reference to the accompanying drawings in which:

FIG. 1 illustrates schematically the circuit of a hearing aid according to the invention, and FIG. 2 illustrates schematically the circuit of a high-frequency peak clipper forming part of the circuit of FIG. 1.

Referring to FIG. 1 the main elements of a hearing aid in accordance with the invention are indicated as a microphone 10, which responds to sound waves to produce via an amplifier 11 an electrical input signal in the audio-frequency band, a high-frequency peak clipper 13, an audio-frequency output amplifier 14 and an earphone 15. The system may be of discrete or integrated construction as required. The amplifier 11 has an automatic gain control (AGC) facility so that the mean value of the electrical input signal is maintained at uniform level. The value of gain provided by the AGC can be varied and the level of the input signal thereby adjusted by the manual operation of an AGC control 12. The clipper 13 performs three functions in transposing the audio input signal to a high-frequency band, limiting the amplitude of the transposed signal and restoring the signal to the audio-frequency band.

The detailed arrangement of the high-frequency clipper 13 will be described first and is shown schematically in FIG. 2. The audio signal from the amplifier 11 (FIG. 1) at an input connection 20 is passed through a phase shifter 21 to give two outputs in phase quadrature on lines 22, 23. The leading phase is carried by line 22 which is connected to a balanced modulator 24; line 23 is connected to a similar balanced modulator 25. A 60 KHz carrier oscillation is generated by an oscillator 26 and passed through a phase shifter 27 to give two outputs in phase quadrature on lines 28 and 29. The leading phase is carried by line 28 which is connected to the modulator 24 and line 29 is connected to the modulator 25. Each of the modulators 24, 25 produces a double-sideband suppressed-carrier signal, the two signals being in phase quadrature. As a result of this process of phase shift modulation, the two signals, when added in an amplifier 30, produce a single-sideband signal. The peak-clipping operation is carried out on this signal by a conventional limiter 31, in which any portion of a waveform which exceeds a predetermined amplitude is rejected.

The signal at the output of the limiter 31 is passed via a high-frequency band pass filter stage 32, which removes the unwanted frequencies produced by the limiter 31, to a synchronous demodulator 33 which receives an in-phase carrier signal from line 29. The output from the demodulator 33 contains a term representing the audio modulation which is separated in a low-pass filter 34. The output from the filter 34 is a tonally undistorted replica of the signal at the input connection 20 in which the original dynamic range has been compressed.

It will be apparent from the discussion in this specification of the nature of nerve deafness that the hearing aid system of FIG. 1 must provide two principal functions. Firstly, the input amplifier 11 and the high-frequency clipper 13 must co-operate to produce a transposed signal which represents, in a small dynamic range, the most significant information-bearing portion of the input sound waveform. Secondly, and after the transposed waveform has been restored to the audio band, the amplifier 14 and the earphone 15 must operate to reproduce the selected dynamic range of the input waveform as far as possible within the dynamic range of the user's ear. In particular the maximum amplitude must be set within this range and for this purpose the amplifier 14 can be pre-set for each patient since the maximum input to the amplifier 14 is constant. It will be shown that the clipping operation can, if desired, be controlled by the patient so that differenty types of sound which vary in amplitude distribution pattern can be brought within his dynamic range.

The nature of the clipping operation and the manner in which it governs dynamic range will be discussed further. As was noted eariler in this specification it is sufficient for intelligibility of speech if only frequency-change information is provided. This condition may be satisfied in a single-sideband waveform, since it represents the original waveform in terms of both amplitude-modulation and frequency-modulation, by clipping almost to the zero-crossing level. This process has been termed 'infinite' clipping. Such a clipped signal, after restoration, would provide an output of constant amplitude. If the clipping threshold is raised to give a finite value of the clipping ratio, of original peak amplitude to clipped amplitude, then a component of amplitude information is also included. Dependent on the nature of the waveform the output may no longer be exactly uniform in amplitude and there may be some improvement in intelligibility if individual characteristics of the speech pattern are partially restored. The threshold may be raised further with increasng gain in information content and a clipping ratio in the region of 10:1 has been found to be suitable in many cases. In generaly it may be found that too little information is yielded by very high ratios and, in the other direction, the advantages of the clipping concept disappear for very small ratios.

The input stage of the hearing aid will now be discussed further in order to make clear that while the limiter 31 operates at a predetermined amplitude the user of the aid is able to control the effective clipping ratio. Such a control facility is advantageous to him in permitting a dynamic range to be selected which is compatible with that of the ear and appropriate to each different source of sound. Suppose the predetermined clipping level of limiter 31 to be denoted by K. Taking account of the effect of the stages of signal processing which occur in the clipper 13 in advance of limiter 31 the level K must correspond to a specific level of amplitude (L, say) in the signal from amplifier 11. It will be recalled that amplifier 11 includes an AGC facility which stabilises the mean value of this signal in the presence of a fluctuating incoming signal; the actual mean value, and correspondingly the peak value of the signal from amplifier 11 is of course dependent on the gain setting of the AGC. The clipping ratio (the ratio of the peak amplitude to the amplitude of the clipping level L) is therefore controllable by varying the gain setting and the patient can make this adjustment to his own satisfaction by means of the manual control 12. The AGC facility should have a long integration time so that speech modulation is not suppressed and so that silences of normal duration between spoken sounds do not cause the amplifier gain to rise unduly so procuding high background noise.

It has been shown in the preceding description how the particular singal characteristic required to ameliorate the defects of nerve deafness can be provided. Similar apparatus is however also of value as an aid to conduction deafness in providing for the user the required amplification of the information content of speech whilst avoiding the pain induced by excessive or unexpected peak levels. It is a further advantage that in devices which must for normal use be made as small as possible the power rating is predetermined and cannot in use be exceeded to cause distortion of the signal or damage to the device.

The derivation of a single sideband signal has been described in relation to FIG. 2 for a phase-shift modulation system. This is a convenient means of obtaining the result but other known means would be suitable, such as a single balanced modulator to produce double sidebands followed by a band-pass filter to remove one of the sidebands. The choice of carrier frequency in such systems is not critical. At the lower limit it must be above the possible range of speech frequencies so that 20 KHz represents a minimum and a value in the region of 100 KHz would represent a reasonable maximum to avoid radiation problems.

We claim:

1. A hearing aid comprising:

means responsive to sound waves to produce an electrical input signal in the audio-frequency band;

means for transposing said input signal to a high-frequency band to produce a transposed signal;

limiting means for limiting the peak amplitude of said transposed signal to a predetermined value to produce a peak-limited signal;

means for restoring said peak-limited signal to the audio-frequency band to produce a restored signal; and means for audio reproduction of said restored signal.

2. A hearing aid in accordance with claim 1 in which said means responsive to sound waves includes input amplifier means arranged to maintain the mean value of said electrical input signal at a substantially uniform level.

3. A hearing aid in accordance with claim 2 in which said input amplifier means includes means for manual adjustment of said mean value of said input signal, said predetermined value being maintained constant, whereby the effective clipping ratio of said limiting means may be varied.

4. A hearing aid in accordance with claim 1 in which said means for transposing said input signal to a high-frequency band includes phase-shift modulation means so arranged that said transposed signal comprises a single sideband.

5. A hearing aid in accordance with claim 1 in which said means for audio reproduction includes output amplifier means, said output amplifier means being presettable so that the maximum level of said audio reproduction lies within the characteristic dynamic range of the hearing defect for which the aid is intended.

6. A hearing aid comprising:

means responsive to sound waves to produce an electrical input signal in the audio-frequency band;

means for producing a carrier signal in the high-frequency band;

means for mixing said input signal and said carrier signal to derive a sideband of said carrier signal;

limiting means for limiting the peak amplitude of said sideband to a predetermined value;

means for mixing said carrier signal and said peak-limited sideband to derive an output signal in the audio-frequency band, said output signal representing said input signal in peak-limiting form; and means for audio reproduction of the said output signal.

7. A hearing aid in accordance with claim 6 in which said means responsive to sound waves includes input amplifier means arranged to maintain the mean value of said electrical input signal at a substantially uniform level.

8. A hearing aid in accordance with claim 7 in which said input amplifier means includes means for manual adjustment of said mean value of said input signal, said predetermined value being maintained constant whereby the effective clipping ratio of said limiting means may be varied.

9. A hearing aid in accordance with claim 8 in which said means for mixing said input signal and said carrier signal comprises phase-shift modulation means.

10. A hearing aid in accordance with claim 6 in which said means for audio reproduction includes output amplifier means, said output amplifier means being presettable so that the maximum level of said audio reproduction lies within the characteristic dynamic range of the hearing defect for which the aid is intended.

* * * * *